United States Patent [19]

Haglund

[11] 4,227,733

[45] Oct. 14, 1980

[54] APPARATUS FOR CONNECTING A LIFTING TACKLE TO A SUBMERSIBLE PUMP

[75] Inventor: Sture Haglund, Sundbyberg, Sweden

[73] Assignee: ITT Industries, Inc., New York, N.Y.

[21] Appl. No.: 951,932

[22] Filed: Oct. 16, 1978

[30] Foreign Application Priority Data

Nov. 24, 1977 [SE] Sweden ..... 7713282

[51] Int. Cl.[3] ..... B66C 1/38

[52] U.S. Cl. ..... 294/83 R

[58] Field of Search ..... 294/83 R, 66 R, 75, 294/83 A, 83 AB, 84, 1; 24/230.5, 232 R, 232 G, 241 P, 241 TC, 242

[56] References Cited

U.S. PATENT DOCUMENTS

| | | | |
|---|---|---|---|
| 350,223 | 10/1886 | Von Der Weilbeike | 294/83 R |
| 4,026,594 | 5/1977 | Kumpulainen | 294/83 R |

*Primary Examiner*—James B. Marbert

*Attorney, Agent, or Firm*—John T. O'Halloran; Peter C. Van Der Sluys

[57] ABSTRACT

A connection yoke includes means at one end thereof for slidably engaging guide members fixedly mounted in a pumping station whereby said yoke may be lowered and guided into a pumping station. Means are provided on the opposite end of said yoke for releasably engaging lifting tackle, whereby said tackle may be lowered into a pumping station for engagement with the lifting loop of a submersible pump and upon engagement, said connecting means releases said lifting tackle.

4 Claims, 7 Drawing Figures

11
2
4
3
10
9
5
3b
7
7a
8
1

11
2
4
3
10
9
5
3b
7
7a
8
1

APPARATUS FOR CONNECTING A LIFTING TACKLE TO A SUBMERSIBLE PUMP

BACKGROUND OF THE INVENTION

1. Field of the Invention

This invention relates to submersible pumps and, more particularly, to an apparatus for connecting a lifting tackle to the lifting loop of a submersible pump.

2. Description of the Prior Art

Submersible pumps are usually disposed in deep pits below the level of the liquid to be pumped which, in many cases, is sewerage. The pumps are usually lowered into the pumping station along substantially vertical guides fixedly positioned within the pumping station so that the pump outlets may be properly aligned and connected to the outlet pipes of the pumping station without using screws or other manual connecting mechanisms. The pumps are usually lifted from the pumping station through the use of a wire or chain which is permanently connected to the pump as shown in U.S. Pat. No. 3,018,925.

The disadvantage of this type of arrangement is that the chain or wire must always be connected to the pump unit and therefore it is subjected to corrosion and collection of sludge and solid particles. In deep pumping stations, the cost of wires and chains for each and every pump disposed therein can be considerable; therefore, the cost of such a pumping station could be substantially reduced if the wire or chain and connecting tackle could be released from the pump unit and used for other pumps. Heretofore, this type of apparatus has not been possible for deep pump stations due to the fact that the lifting tackle could not be connected to the pump unit when it was submerged far below the water surface.

SUMMARY OF THE INVENTION

The present invention contemplates a solution to the problem by slidably mounting a removable yoke to the guide means so that it may be lowered into the pumping station by a wire. The yoke is provided with a connecting means which, during lowering of the yoke, retains a lifting tackle in a horizontal position so that the tackle may engage the lifting loop of the pump unit. Upon engagement of the tackle with the lifting loop, the tackle rotates into a vertical position, at which position the connecting means releases the lifting tackle so that the pump may be lifted from the pumping station by a wire or chain attached to the lifting tackle.

DESCRIPTION OF THE INVENTION

Figure 1:
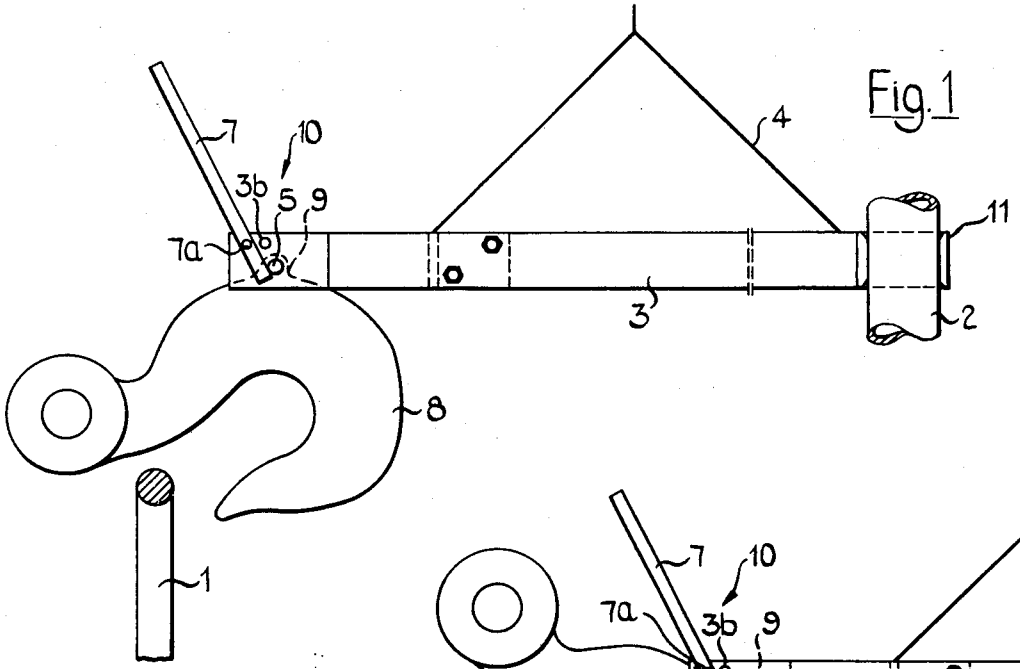
FIGS. 1 to 3 are side views of the present invention showing the sequential engagement of a lifting loop of a pump unit.

Referring to FIG. 1, there is shown a lifting loop 1 mounted on a submersible pump and a yoke 3 adapted to slidably engage guides 2. A lifting wire 4 is connected to yoke 3 for lowering and lifting the yoke into and out of a pumping station. Connecting means 10 is provided for engaging a lifting tackle 8 having a connecting ear 9. Ear 9 is merely a protrusion on the side of the lifting tackle 8 which has an opening formed therethrough, which opening is engaged by a pin 5 of the connecting means 10.

Figure 5A:
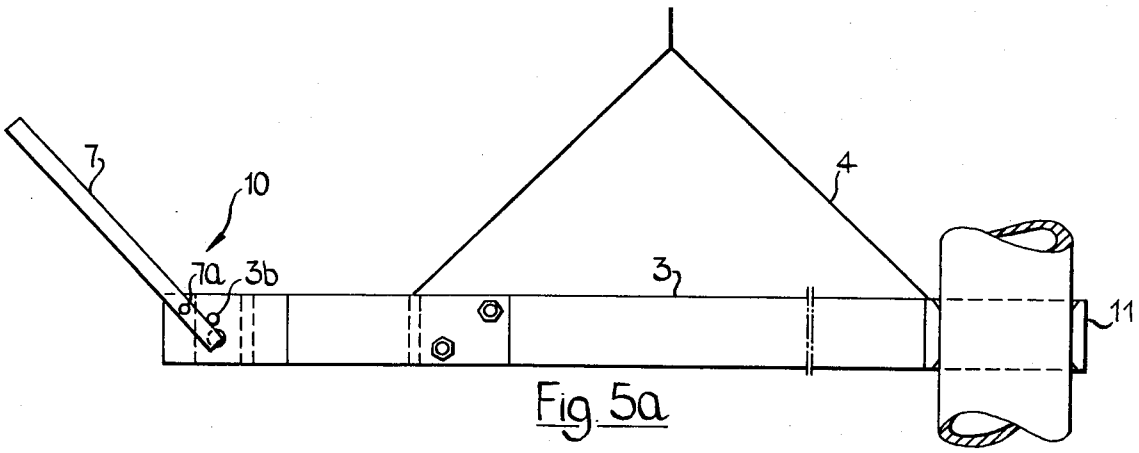
FIGS. 5*a* and 5*b* show a top view of the present invention in a position in which the lifting tackle would be released.
Figure 5B:
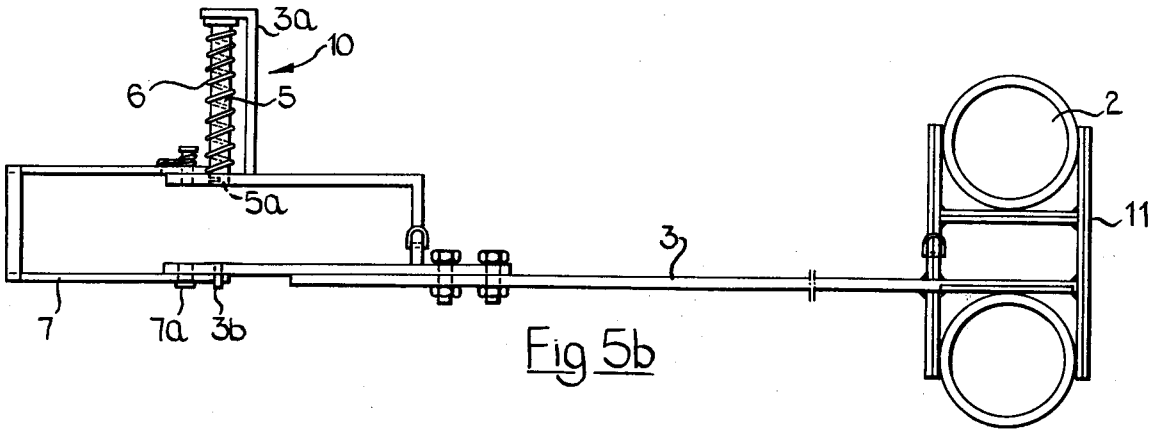

Referring to FIGS. 4*a*, 4*b*, 5*a* and 5*b*, there is shown the yoke 3 in greater detail. Engaging means 11 are provided at one end to slidably engage the guides 2 and the connecting means 10 is formed at the other end and includes pin 5, spring 6 and stop arm 7 pivotally mounted to the yoke 3. Pin 5 includes at one end thereof an annular groove 5*a* which may be engaged by the stop arm 7 to prevent the spring 6 from moving the pin in an axial direction. Yoke 3 includes a stop 3*a* for preventing excessive travel of pin 5 in the axial direction. Stop arm 7 is pivotally mounted to the yoke 3 by a pivot means 7*a*, and the yoke 3 includes a stop pin 3*b* for preventing the stop arm 7 from rotating to a vertical position after the pin 5 is released as shown in FIGS. 5*a* and 5*b*.

When a pump unit is to be lifted from a pumping station, the tackle 8 is mounted to yoke 3 by inserting pin 5 through the opening in ear 9, and the annular groove 5*a* is engaged by the stop arm 7 to resist the force of spring 6. The yoke 3 is slidably mounted to the guides 2, and the assembly is then lowered by wire 4 into the pumping station, with the tackle 8 taking a balanced horizontal position as shown in FIG. 1.

Figure 2:
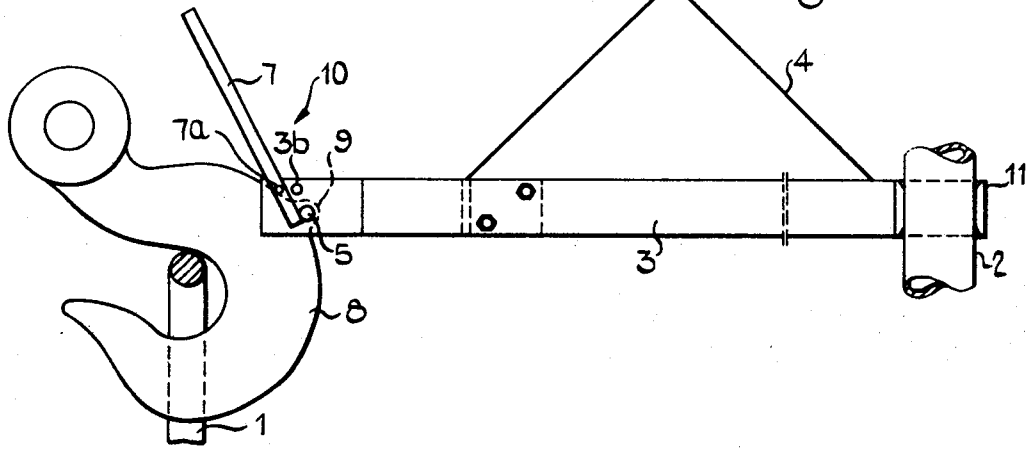
Figure 3:
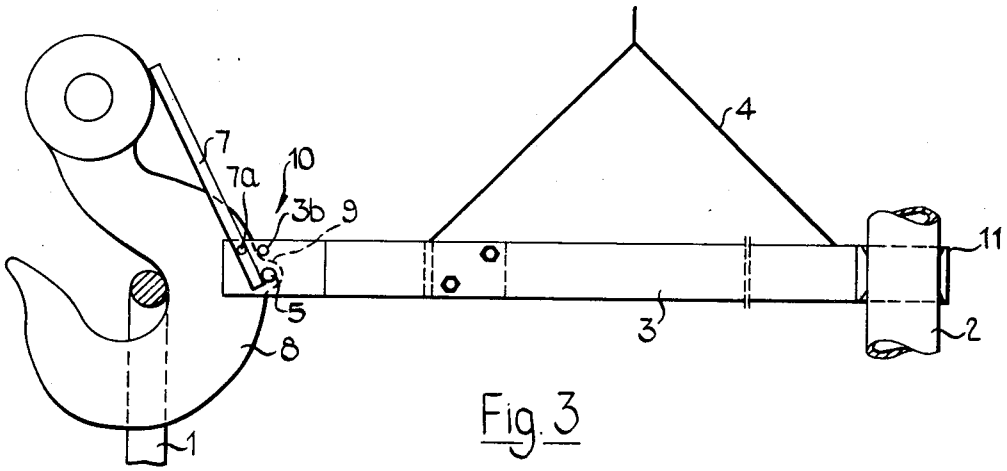
Figure 4A:
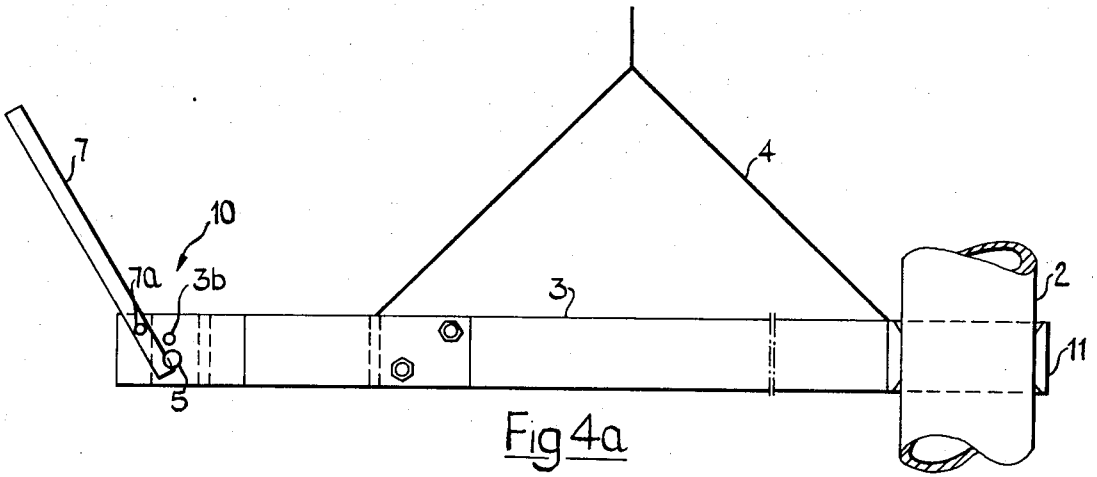
FIGS. 4*a* and 4*b* show a top view of the apparatus of the present invention in a position adapted to engage and retain the lifting tackle.
Figure 4B:
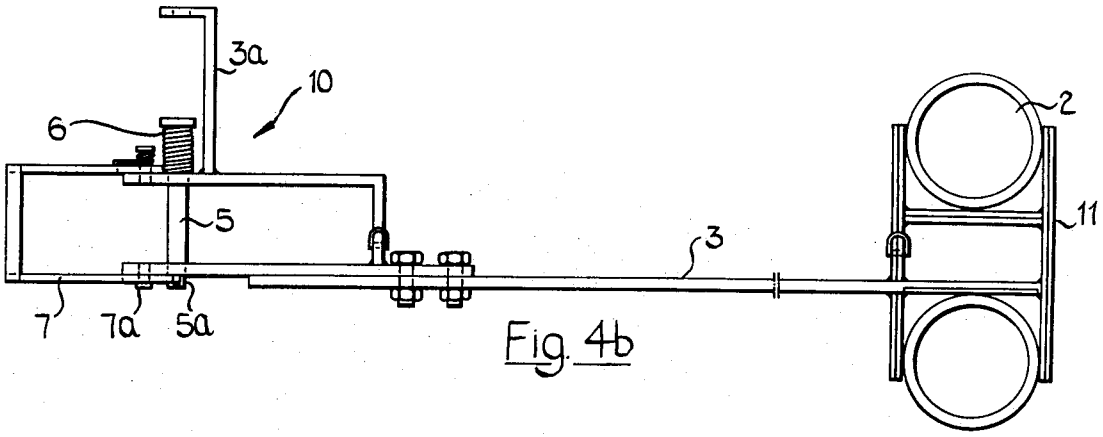

When the yoke 3 and the lifting tackle 8 approach the lifting loop 1, the tackle 8 engages the lifting loop at its inner edge causing the tackle 8 to rotate about the lifting loop as shown in FIGS. 2 and 3. When the tackle 8 is turned to the position shown in FIG. 3, the tackle engages the end of stop arm 7, which then rotates about pivot means 7*a* so that the stop arm disengages the groove 5*a* of pin 5 and allows the spring 6 to move the pin 5 axially, thereby disengaging the tackle 8. The connection yoke 3 may then be lifted away by means of wire 4 and removed from the guides 2, after which the pump may be raised by the tackle 8 and a wire or chain attached thereto.

Thus, the present invention provides an easy way for connecting a lifting tackle to a submersible pump and provides for the elimination of the need for a chain or wire for each pump used in a pumping station. In addition, the difficulties associated with corroded chains and wires are eliminated, and there is little risk of a pump being isolated in the bottom of a pumping station due to a broken chain or wire caused by corrosion.

What is claimed is:

1. An apparatus for connecting a lifting tackle to a lifting loop of a submersible pump, said apparatus being adapted to be lowered into a pumping station along essentially vertical guides, comprising:

a connection yoke;

means formed at one end of said connection yoke for slidably engaging said guides; and means disposed at an opposite end of said connection yoke for releasably securing a lifting tackle in a substantially horizontal position and for automatically releasing said tackle upon contact of the tackle with the lifting loop, said securing means comprising a slidable pin member for engaging the lifting tackle, a spring adapted to urge the pin out of engagement with the lifting tackle, and a stop arm for holding the pin against the spring force until said stop arm is engaged by the lifting tackle and is rotated to release the pin so that the spring slides the pin out of engagement with the lifting tackle, whereby a lifting tackle may be lowered into a pumping station for engagement with the lifting loop of a submersible pump.

2. A device according to claim 1 wherein the pin includes groove means for engagement by the stop arm to be held against the action of said spring.

3. A device according to claim 2, additionally comprising stop means to limit the movement of the pin under the influence of said spring.

4. A device according to claim 2, wherein the stop arm is pivotally mounted to said connection yoke and is rotated out of engagement with the groove of said pin by engagement of the lifting tackle.

* * * * *